US011450249B2

(12) United States Patent
Song et al.

(10) Patent No.: US 11,450,249 B2
(45) Date of Patent: Sep. 20, 2022

(54) DISPLAY DEVICE AND COMPENSATION METHOD THEREOF

(71) Applicant: LG Display Co., Ltd., Seoul (KR)

(72) Inventors: Ji-Hee Song, Seoul (KR); Chul-Kwon Lee, Gimpo-si (KR); Ho-Chul Lee, Seoul (KR); Ji-Hwan Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/121,298

(22) Filed: Dec. 14, 2020

(65) Prior Publication Data

US 2021/0192998 A1 Jun. 24, 2021

(30) Foreign Application Priority Data

Dec. 24, 2019 (KR) ..... 10-2019-0173873

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01); *G09G 2310/08* (2013.01); *G09G 2320/046* (2013.01); *G09G 2320/0626* (2013.01)

(58) Field of Classification Search
CPC ..... G09G 2320/043–048; G09G 3/30–3291; G09G 3/006
See application file for complete search history.

(56) References Cited

U.S. PATENT DOCUMENTS

2015/0194096 A1* 7/2015 Chung ..... G09G 3/3225 345/78
2017/0098403 A1* 4/2017 Chung ..... G09G 3/3266

FOREIGN PATENT DOCUMENTS

KR 10-2018-0042883 A 4/2018

* cited by examiner

*Primary Examiner* — Hang Lin
(74) *Attorney, Agent, or Firm* — Fenwick & West LLP

(57) ABSTRACT

Disclosed are a display device and a compensation method thereof for preventing and compensating for deterioration of pixels using average data of stress for each pixel. The display device includes a display panel comprising a plurality of pixels provided thereon and configured to display an image, a display driver configured to output a driving signal for driving the display panel, a timing controller configured to generate stress data by converting grayscale values included in image data into stress values, to accumulate the stress data for each pixel, to calculate average data for each pixel corresponding to an accumulated number of times, to determine a compensation value by performing lossless and lossy compression and restoration on the average data in a regular region and an irregular region, respectively, and to provide the compensation value to the display driver.

17 Claims, 11 Drawing Sheets

DISPLAY DEVICE AND COMPENSATION METHOD THEREOF

CROSS-REFERENCE TO RELATED APPLICATIONS

This application claims the benefit of Republic of Korea Patent Application No. 10-2019-0173873, filed on Dec. 24, 2019, which is hereby incorporated by reference as if fully set forth herein.

BACKGROUND

Field

The present disclosure relates to a display device and a compensation method thereof, and more particularly to a display device and a compensation method thereof for preventing and compensating for deterioration of pixels using average data of stress for each pixel.

Discussion of the Related Art

Recently, various flat display apparatuses having reduced weight and volume have been developed, thus overcoming the disadvantages of cathode ray tubes. Examples of the flat display apparatuses include a liquid crystal display device, a field emission display device, a plasma display panel, and an organic light-emitting display device.

Among the flat display apparatuses, the organic light-emitting display device displays an image using an organic light-emitting diode (OLED) that generates light via recombination of electrons and holes. The organic light-emitting display device simultaneously exhibits the advantages of high response speed and low power consumption.

The organic light-emitting display device may include a plurality of pixels arranged at intersections between scan lines and data lines. Each pixel includes an OLED that emits light with brightness corresponding to a data signal, and thus a pixel unit displays an image.

However, as time elapses, an OLED deteriorates depending on the light emission time and brightness (the amplitude of current), and thus lowering the luminescent efficiency of the OLED. As such, when the luminescent efficiency of the OLED is lowered, the brightness of the OLED may be lowered. In particular, when the reduction in brightness is different for each pixel, image quality may be degraded and image sticking may occur. Thus, it is required to improve image quality by appropriately compensating for the deterioration of pixels attributable to the accumulated emission of each pixel.

In order to compensate for image quality failure due to the deterioration, an image data processor in a display device generates compensation data. A controller provides the compensation data for compensating for deterioration of an OLED to a display driver and compensates for the brightness and the image sticking of a display. The controller converts the compensation data into stress data. As the amount of compensation data is increased, stress data having an increased value is output. A compressor is configured to reduce the capacity of a storage device and accumulatively stores compressed stress data. The stored data is restored by a restorer and is transmitted to a compensator. The compensator calculates compensation data based on the stored data and provides the calculated compensation data to a driver.

SUMMARY

An object of the present disclosure is to provide a display device and a compensation method thereof for effectively compensating for deterioration of pixels.

Another object of the present disclosure is to provide a display device and a compensation method thereof for improving ability of compensating for image sticking by reducing loss in a regular region.

In an aspect, the present disclosure provides a display device including a display panel including a plurality of pixels provided thereon and configured to display an image, a display driver configured to output a driving signal for driving the display panel, and a timing controller configured to generate stress data by converting grayscale values included in image data into stress values, to accumulate the stress data for each pixel, to calculate average data for each pixel corresponding to an accumulated number of times, to determine a compensation value by performing lossless and lossy compression and restoration on the average data in a regular region and an irregular region, respectively, and to provide the compensation value to the display driver.

The timing controller in the display device may map each of the grayscale values included in the image data to a predetermined mapping table and may convert the mapped data into stress data.

The timing controller in the display device may include a data accumulator configured to accumulate the stress data and to extract accumulated stress data, an average data processor configured to perform compression and restoration using average data calculated by dividing the accumulated stress data accumulated by the data accumulator by an accumulated number of times, a memory configured to store the compressed data provided from the average data processor, and a deterioration and compensation value determiner configured to predict deterioration by analyzing the accumulated stress data restored by the average data processor and to determine a compensation value for the deterioration.

The accumulated stress data in the display device may have a size of 32 bits, and the average data may have a size of 16 bits.

The data accumulator in the display device may include a current usage calculator configured to calculate usage of a current pixel by analyzing current image data, and an accumulated usage calculator configured to calculate accumulated stress data by accumulating the data calculated by the current usage calculator.

The average data processor in the display device may include an average data compressor configured to extract a representative value of average data of each block by dividing each pixel line of the display panel into a plurality of blocks, to determine a difference value between data of each block and the representative value, to compress the difference value to a size required to store the difference value, and to store the difference value in the memory, and an average data restorer configured to extract the representative value by reading the compressed data stored in the memory and to restore the accumulated data using difference values.

The average data compressor in the display device may use a lossless compression method in a regular region in which an image is fixed and a lossy compression method in an irregular region in which an image is changed, using a DPCM method, entropy coding, and a fixed-length coding algorithm.

The average data compressor in the display device may calculate an available space of compressed data from an amount of lossy-compressed data, may perform quantization to compress the difference value from the accumulated data only by as much as the available space, and may compress the quantized difference value to a predetermined bit size.

The compensation value in the display device may be image-sticking compensation data for compensating for deterioration of the plurality of pixel units.

In another aspect, the present disclosure provides a compensation method of a display device, including generating stress data by converting grayscale values included in image data to be displayed on a display panel into stress values, calculating average data of stress data for each pixel, compressing the average data, storing the compressed average data in a memory, reading the data stored in the memory and restoring accumulated stress data using the compressed average data, predicting deterioration by analyzing the accumulated stress data and determining a compensation value for the deterioration, and driving the display panel using the compensation value.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION

Figure 1:
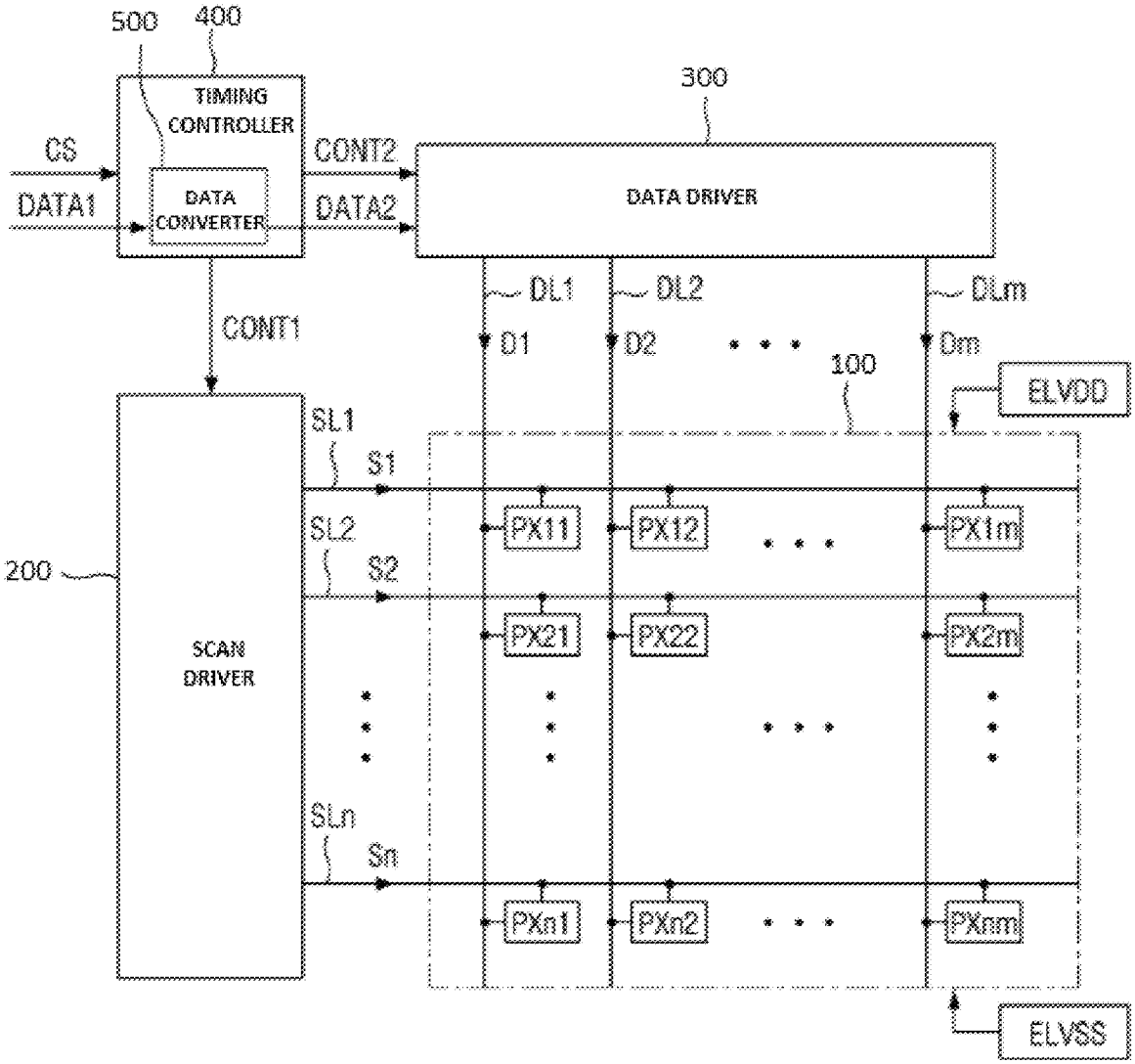
FIG. 1 is a schematic block diagram of a display device according to an embodiment of the present disclosure.

In exemplary embodiments of the present disclosure disclosed in the specification, specific structural and functional descriptions are merely illustrated for the purpose of illustrating embodiments of the invention and exemplary embodiments of the present disclosure may be embodied in many forms and are not limited to the embodiments set forth herein.

Exemplary embodiments of the present disclosure can be variously changed and embodied in various forms, in which illustrative embodiments of the invention are shown. However, exemplary embodiments of the present disclosure should not be construed as being limited to the embodiments set forth herein and any changes, equivalents or alternatives which are within the spirit and scope of the present disclosure should be understood as falling within the scope of the invention It will be understood that although the terms first, second, third etc. may be used herein to describe various elements, these elements should not be limited by these terms. These terms are only used to distinguish one element from another element. For example, a first element may be termed a second element and a second element may be termed a first element without departing from the teachings of the present disclosure.

It will be understood that when an element, such as a layer, a region, or a substrate, is referred to as being "on", "connected to" or "coupled to" another element, it may be directly on, connected or coupled to the other element or intervening elements may be present. In contrast, when an element is referred to as being "directly on," "directly connected to" or "directly coupled to" another element or layer, there are no intervening elements or layers present. Other words used to describe the relationship between elements or layers should be interpreted in a like fashion, e.g., "between," versus "directly between," "adjacent," versus "directly adjacent," etc.

The terms used in the present specification are used for explaining a specific exemplary embodiment, not limiting the present inventive concept. Thus, the singular expressions in the present specification include the plural expressions unless clearly specified otherwise in context. Also, terms such as "include" or "comprise" may be construed to denote a certain characteristic, number, step, operation, constituent element, or combination thereof, but may not be construed to exclude the existence of or possibility of addition of one or more other characteristics, numbers, steps, operations, constituent elements, or combinations thereof.

Unless otherwise defined, all terms including technical and scientific terms used herein have the same meaning as commonly understood by one of ordinary skill in the art to which this inventive concept pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

When exemplary embodiments are embodied in various ways, a function or operation stated in a specific block may be executed in a different way from an order stated in a flowchart. For example, two consecutive blocks may be substantially simultaneously executed and may be reversely executed according to a related function or operation.

Hereinafter, a display device and a compensation method of a display device will be described with reference to the accompanying drawings.

FIG. 1 is a schematic block diagram of a display device according to an embodiment of the present disclosure.

Referring to FIG. 1, an organic light-emitting display device according to an embodiment of the present disclosure may include a display panel 100, a scan driver 200, a data driver 300, and a timing controller 400.

The display panel 100 may be an area for displaying an image. The display panel 100 may be electrically connected to the scan driver 200 through first to $n^{th}$ scan lines SL1 to SLn (n being a natural number equal to or greater than 2). The display panel 100 may be electrically connected to the data driver 300 through first to $m^{th}$ data lines DL1 to DLm (m being a natural number equal to or greater than 2). The display panel 100 may include a plurality of pixel units PX11 to PXnm. According to an embodiment, the plurality of pixel units PX11 to PXnm may be electrically connected to one of the first to $n^{th}$ scan lines SL1 to SLn and one of the first to $m^{th}$ data lines DL1 to DLm. The plurality of pixel units PX11 to PXnm may be insulated from each other on one substrate, and according to an embodiment, may be arranged in a matrix form.

The first to $n^{th}$ scan lines SL1 to SLn may extend in a first direction d1. The first to $m^{th}$ data lines DL1 to DLm may extend in a second direction d2. According to an embodiment, the first direction d1 may cross the second direction d2. Based on FIG. 1, the first direction d1 is illustrated to be a row direction, and the second direction d2 is illustrated to be a column direction.

A display driver for driving the display panel 100 may include the scan driver 200 and the data driver 300.

The scan driver 200 may receive a first control signal CONT1 from the timing controller 400. The scan driver 200 may provide first to $n^{th}$ scan signals S1 to Sn to the display panel 100 according to the first control signal CONT1.

The data driver 300 may receive a second control signal CONT2 and second image data DATA2 from the timing controller 400. The data driver 300 may select a reference voltage in response to the second control signal CONT2. The data driver 300 may convert the second image data DATA2 in a digital waveform into first to $m^{th}$ data signals D1 to Dm according to the selected reference voltage. The data driver 300 may provide the plurality of generated data signals D1 to Dm to the display panel 100. According to an embodiment, the data driver 300 may include a shift register, a latch, and a digital-analog converter (DAC).

The timing controller 400 may receive first image data DATA1 and a control signal CS from the outside. In an embodiment, the control signal CS may include a vertical synchronization signal Vsync, a horizontal synchronization signal, a main clock signal, and a data enable signal. The timing controller 400 may process the signal provided from the outside to be appropriate for the operating conditions of the display panel 100 and may then generate the second image data DATA2, the first control signal CONT1, and the second control signal CONT2.

The first control signal CONT1 may include a scan start signal indicating the start of output of the first to $n^{th}$ scan signals S1 to Sn and a gate clock signal for controlling the output timing of a scan-on pulse. The second control signal CONT2 may include a horizontal synchronization start signal indicating the start of input of the second image data DATA2 and a rod signal for control of application of first to $m^{th}$ data signals D1 to Dm to the first to $m^{th}$ data lines DL1 to DLm.

The timing controller 400 may include a data converter 500. The data converter 500 may receive the first image data DATA1 from the outside and may generate the second image data DATA2 by performing a predetermined computation. The data converter 500 may provide the generated second image data DATA2 to the data driver 300. Although FIG. 1 illustrates the case in which the data converter 500 is included in the timing controller 400 configured therein, the present disclosure is not limited thereto. That is, the data converter 500 may be configured outside the timing controller 400.

The data converter 500 may generate stress data by converting grayscale values included in image data into stress values, may accumulate stress data for respective pixels, may calculate average data for respective pixels corresponding to an accumulated number of times, may determine a compensation value by performing lossless and lossy compression and restoration on the average data in a regular region and an irregular region, respectively, and may provide the compensation value to the display driver. To this end, the timing controller 400 may include a component for mapping each of the grayscale values included in the image data to a predetermined mapping table and converting the mapped data into stress data. The detailed configuration and operation of the data converter 500 will be described below in more detailed with reference to FIG. 3.

Although not shown, the organic light-emitting display device according to an embodiment of the present disclosure may further include a power supply. The power supply may provide a control signal to the timing controller 400. The power supply may provide a first driving voltage ELVDD and a second driving voltage ELVSS to the plurality of pixel units PX11 to PXnm according to the control signal. Here, the first driving voltage ELVDD may have a higher potential than the second driving voltage ELVSS.

Figure 2:
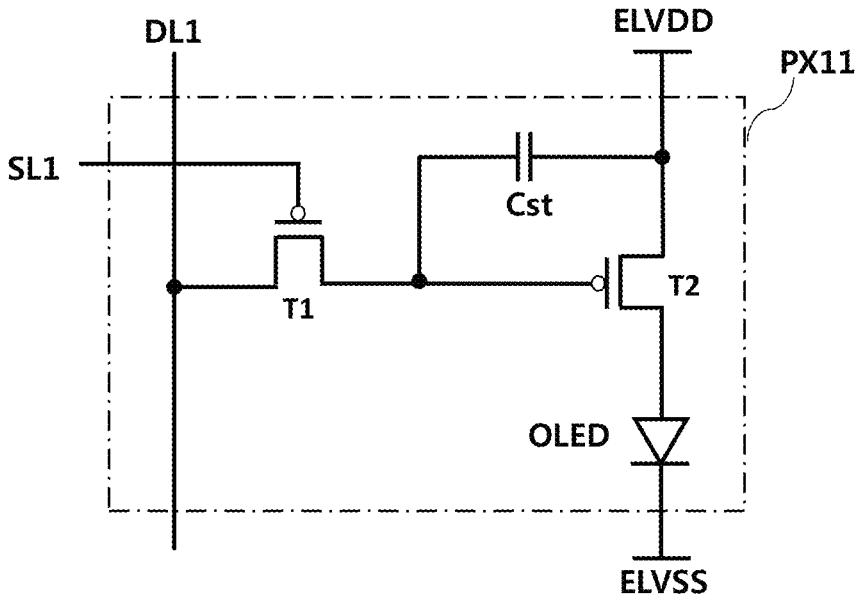
FIG. 2 is an equivalent circuit diagram showing the pixel unit shown in FIG. 1 according to an embodiment of the present disclosure.

FIG. 2 is an equivalent circuit diagram showing the pixel unit shown in FIG. 1 according to an embodiment of the present disclosure. A description of FIG. 2 will be given based on the pixel unit PX11 that is electrically connected to each of the first data line DL1 and the first scan line SL1.

The pixel unit PX11 may be electrically connected to each of the first scan line SL1 extending in the first direction d1 and the first data line DL1 extending in the second direction d2. According to an embodiment, the pixel unit PX11 may include a first switching device T1, a second switching device T2, a storage capacitor Cst, and an organic light-emitting diode OLED. According to an embodiment, each of the first switching device T1 and the second switching device T2 may be a three-terminal device such as a thin film transistor. Each of the first switching device T1 and the second switching device T2 may be an NMOS-type thin film transistor. Hereinafter, an example in which each of the first switching device T1 and the second switching device T2 is an n-type transistor that is operated by receiving a low logic voltage as a gate-on voltage will be described. Although an organic light-emitting display device is described by way of example according to the present embodiment, the present disclosure is not limited thereto, and may be applied to various display devices for displaying an image signal.

The first switching device T1 may include a gate electrode that is electrically connected to the first scan line SL1, a source electrode that is electrically connected to the first data line DL1, and a drain electrode that is electrically connected to a gate electrode of the second switching device T2.

The second switching device T2 may include a gate electrode that is electrically connected to a drain electrode of the first switching device T1, a source electrode that receives the first driving voltage ELVDD, and a drain electrode that is electrically connected to the organic light-emitting diode OLED.

The storage capacitor Cst may have one electrode electrically connected to a drain electrode of the first switching device T1 and may receive the first driving voltage ELVDD through the other electrode.

The first switching device T1 may be turned on according to a first scan signal received through the first scan line SL1 and may provide a first data signal received through the first data line DL1 to the storage capacitor Cst. The storage capacitor Cst may be charged with a voltage difference between the received first data signal and the first driving voltage ELVDD.

The second switching device T2 may control the amplitude of driving current provided to a second driving voltage terminal (not shown) to which the second driving voltage ELVSS is provided through the organic light-emitting diode OLED from a first driving voltage terminal (not shown) to which the first driving voltage ELVDD is provided, depending on the voltage charged in the storage capacitor Cst. That is, the first switching device T1 may be a switching transistor, and the second switching device T2 may be a driving transistor.

Figure 3:
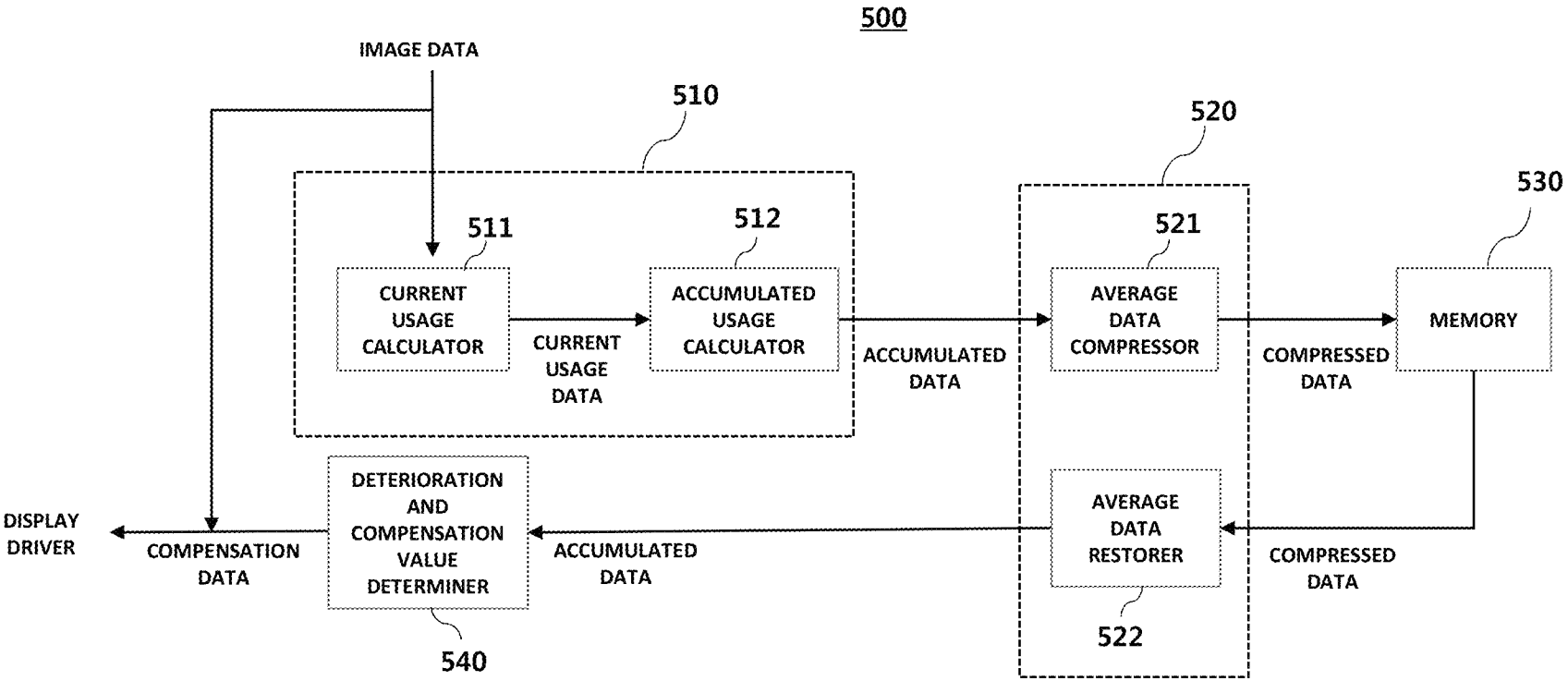
FIG. 3 is a block diagram showing the data converter illustrated in FIG. 1 in more detail according to an embodiment of the present disclosure.

FIG. 3 is a block diagram showing the data converter illustrated in FIG. 1 in more detail according to an embodiment of the present disclosure. As shown in the drawing, the data converter 500 may include a data accumulator 510 configured to accumulate stress data and to extract accumulated stress data, an average data processor 520 configured to perform compression and restoration using average data calculated by dividing the accumulated stress data accumulated by the data accumulator 510 by an accumulated number of times, a memory 530 configured to store the compressed data provided from the average data processor 520, and a deterioration and compensation value determiner 540 configured to predict deterioration by analyzing the accumulated stress data, restored by the average data processor 520, and to determine a compensation value for the deterioration.

According to an embodiment of the present disclosure, the accumulated stress data may have a size of 32 bits and the average data may have a size of 16 bits.

The average data processor 520 may include an average data compressor 521, configured to divide each pixel line of a display panel into a plurality of blocks, to calculate average data for each of the plurality of blocks, to extract a representative value of average data of each block, to determine a data of each block as a difference value between the average data of each block and the extracted representative value, to compress the difference value to a size required to store the difference value, and to store the same in the memory 530, and an average data restorer 522 configured to extract the representative value by reading the compressed data stored in the memory 530 and to restore the accumulated data using difference values.

The average data compressor 521 may compress stress data by performing a lossless compression method in a regular region in which an image is fixed and a lossy compression method in an irregular region in which an image is changed, using a DPCM method, entropy coding, and a fixed-length coding algorithm.

The deterioration and compensation value determiner 540 may calculate a difference value from actual accumulated data by restoring accumulated data of the lossless-compressed data. The deterioration and compensation value determiner 540 may calculate an available space of compressed data from the amount of lossy-compressed data. The deterioration and compensation value determiner 540 may perform quantization to compress the difference value from the accumulated data only by as much as the available space and may compress the quantized difference value to a predetermined bit size. In this case, the compensation value may be, for example, image-sticking compensation data for compensating for deterioration of a plurality of pixel units of a display panel.

Figure 4:
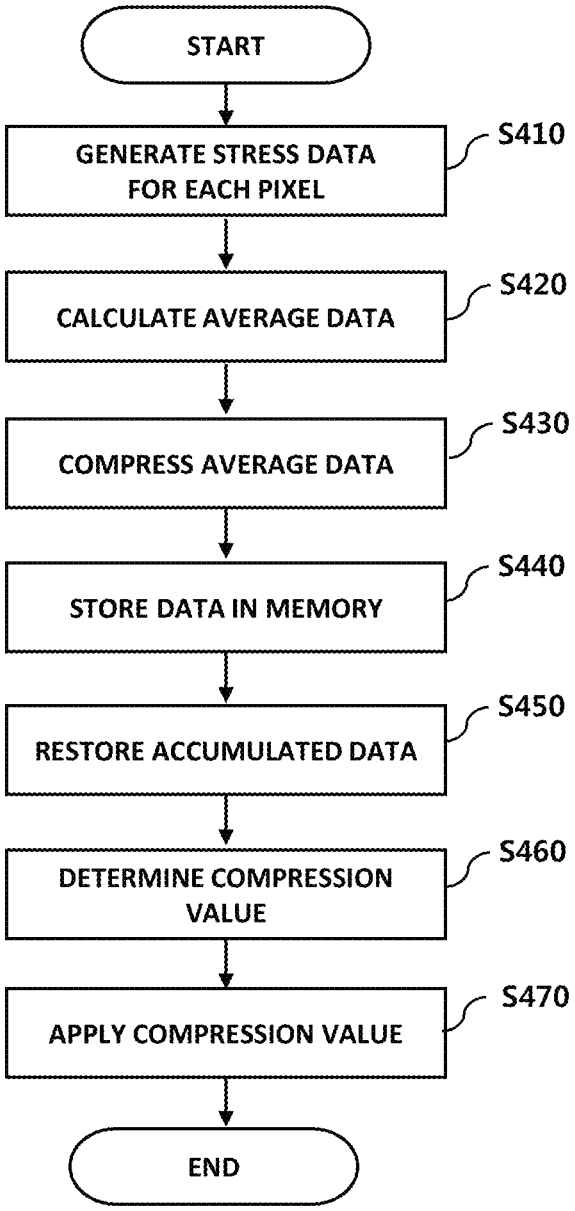
FIG. 4 is a flowchart showing a compensation method of an organic light-emitting display device according to an embodiment of the present disclosure.

FIG. 4 is a flowchart showing a compensation method of an organic light-emitting display device according to an embodiment of the present disclosure. According to the present disclosure, image data processing for compensation may be performed by the data converter 500 in the timing controller 400, and thus the entity that performs each operation in the following flowchart may be the data converter 500.

A current usage calculator 511 may generate stress data by converting grayscale values included in the image data to be displayed on a display panel into stress values. The stress data (stress data value (n)) may indicate stress applied to an organic light-emitting diode (OLED), that is, the degree of deterioration of the OLED. As data with a high grayscale value is input to the OLED, deterioration of the OLED may be quickened (S410).

An accumulated usage calculator 512 may accumulate current stress data for each pixel provided from the current usage calculator 511. When a grayscale value of stored stress data is SD1, SD2, SD3, to SDn, stress data λn in which grayscale values of nth stress data are accumulated may be calculated. For example, the accumulated stress data λn may be the sum of SD1 to SDn, calculated using Equation 1 below.

$$\lambda n = \Sigma_{i=1}^{n} SDi \qquad \text{[Equation 1]}$$

Although the method of calculating the accumulated stress data λn is described with reference to Equation 1 above, the method of calculating the accumulated stress data is not limited thereto. In this case, information on an accumulated number of times may be stored therewith. The average data compressor 521 of the average data processor 520 may calculate average data of stress data for each pixel by dividing the accumulated stress data by the accumulated number of times (S420).

The average data compressor 521 may compress the average data using a lossy compression method and a lossless compression method. A detailed compression method will be described below in detail with reference to FIGS. 6 to 10 (S430).

The average data compressor 521 may store the compressed average data in the memory 530 (S440).

The average data restorer 522 of the average data processor 520 may restore accumulated stress data by reading the compressed average data stored in the memory 530 (S450).

The deterioration and compensation value determiner 540 may receive the restored accumulated data from the average data restorer 522. The deterioration and compensation value determiner 540 may predict deterioration by analyzing the restored data and may determine a compensation value for the deterioration. In this case, the compensation value may be image-sticking compensation data for compensating for the deterioration of a plurality of pixel units of a display panel (S460).

The deterioration and compensation value determiner 540 may generate the second image data DATA2 by applying the determined compensation value, may supply the second image data DATA2 and the second control signal CONT2 to the data driver 300, and may provide the first control signal CONT1 to the scan driver 200. The display driver (a data driver and a scan driver) may drive the display panel using the image data to which the provided compensation value is applied and the control signal (S470).

As such, the timing controller 400 of the display device according to the present disclosure may convert compensation data into stress data, and may estimate the degree of deterioration of the OLED by storing the stress data in the memory 530. The timing controller 400 may estimate the degree of deterioration of organic light-emitting data based on the accumulated stress data, may calculate compensation data, and may supply the same to the display driver, thereby compensating the brightness and the image sticking of the display panel 100.

Figure 5:
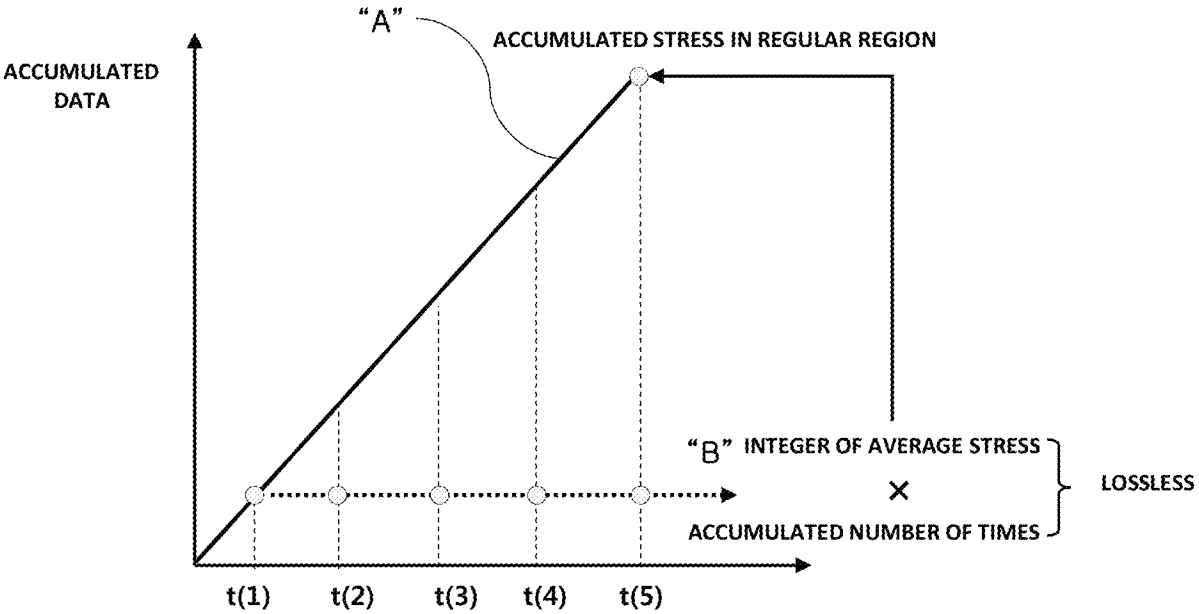
FIG. 5 is a diagram showing an example of accumulated data and average data of an accumulated number of times in a regular region.
Figure 7:
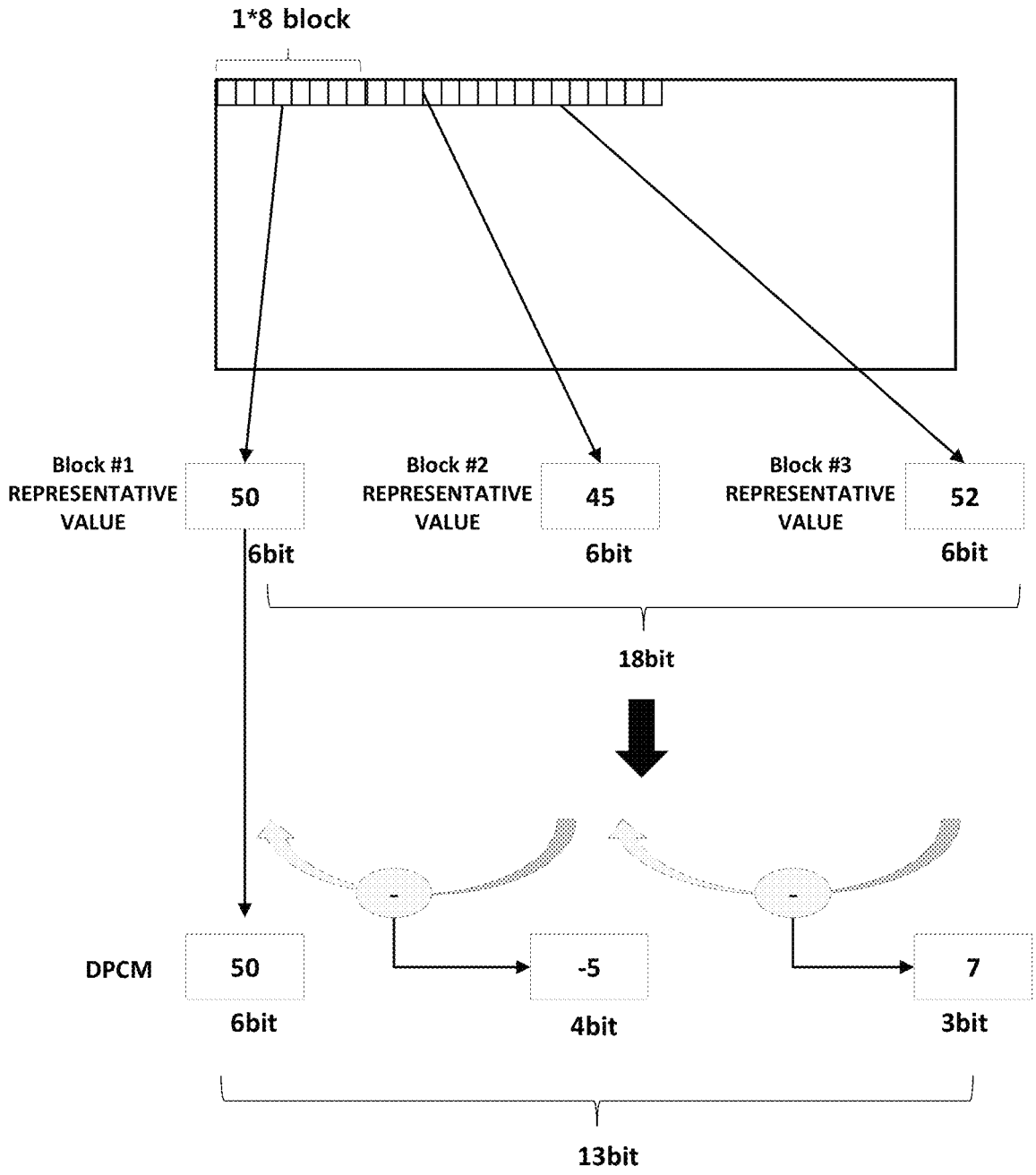
FIG. 7 is a diagram showing an example in which data is stored in a memory when lossless compression is performed using a first compression method M1 in a regular region.
Figure 8:
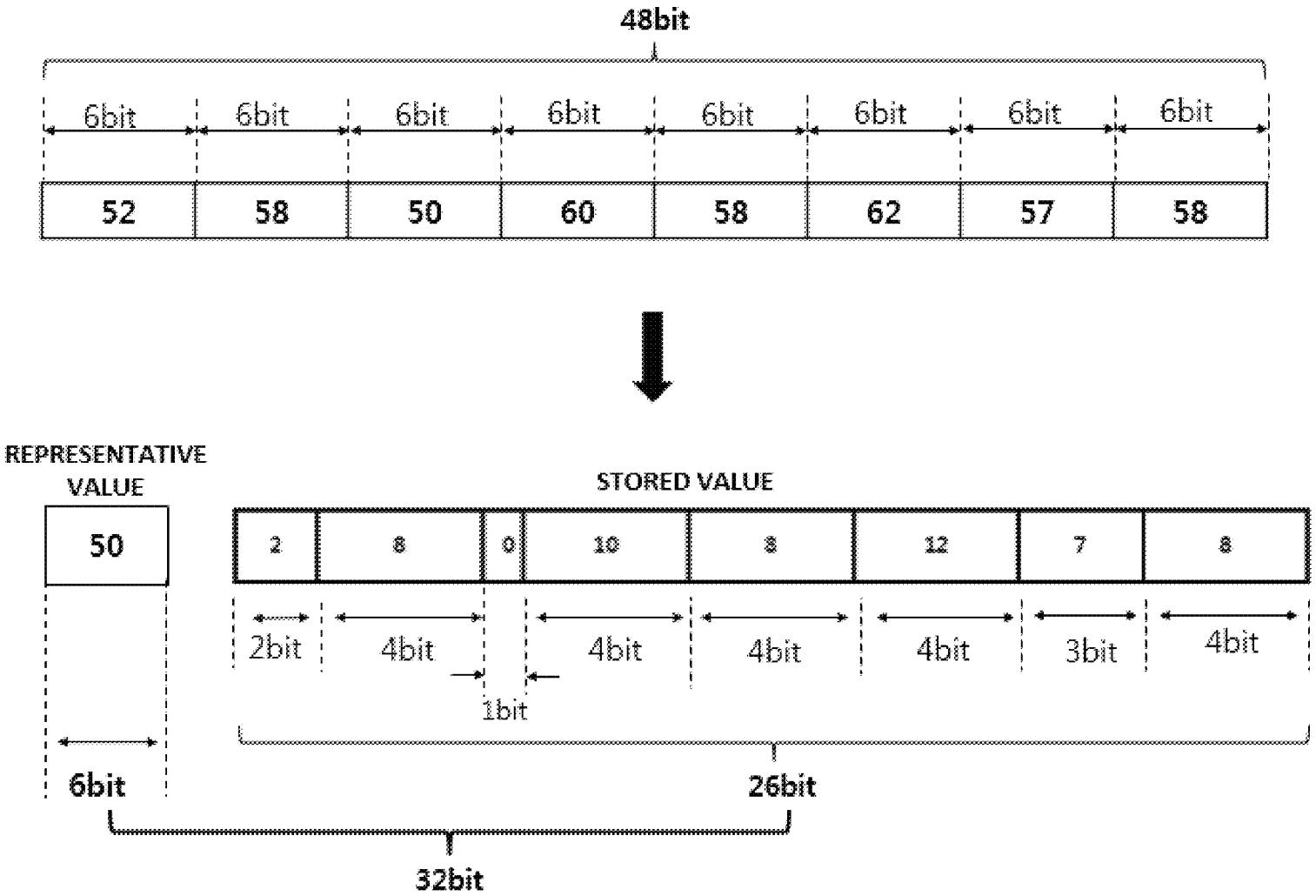
FIG. 8 is a diagram showing an example in which data is stored in a memory when lossless compression is performed using a second compression method M2 in a regular region.

FIG. 5 is a diagram showing an example of accumulated data and average data of an accumulated number of times in a regular region. The stress data of input data in the regular region may be linearly accumulated as shown in "A". For example, accumulated stress data obtained during a predetermined five times (t(1),t(2), to t(5)) is obtained by accumulating the same stress data five times, and thus is linearly indicated. In this case, the average stress data of each number of times may be a value B obtained by dividing the accumulated stress data by an accumulated number of times, and may be compressed using a lossless compression method as shown in FIGS. 6 to 8.

Figure 6:
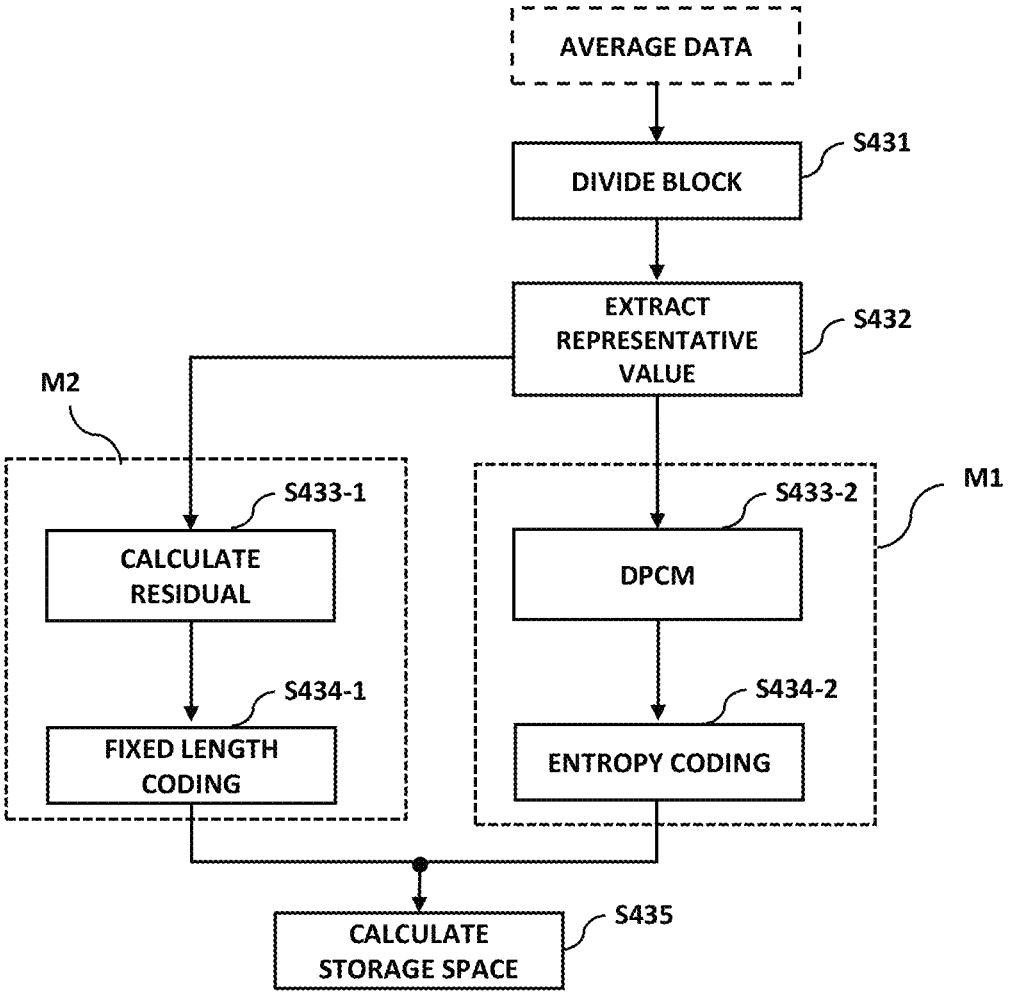
FIG. 6 is a flowchart showing lossless compression procedures of a compensation method of an organic light-emitting display device according to an embodiment of the present disclosure.

FIG. 6 is a flowchart showing lossless compression procedures of a compensation method of an organic light-emitting display device according to an embodiment of the present disclosure. FIG. 7 shows an example of a first compression method M1 when lossless compression is performed. FIG. 8 shows an example of a lossless compression method using a second compression method M2. The following operations may be performed by the average data compressor 521, and thus the entity of the operations may be the average data compressor 521.

After average data is provided from the data accumulator 510, each line of a display panel may be divided into a plurality of blocks. That is, each line may be divided into a plurality of blocks using a plurality of pixels as one block unit. Average data may correspond to each pixel (S431).

Then, a representative value of average data of each block may be extracted. For example, as exemplified in FIG. 7, it is assumed that a representative value of Block #1 is "50", a representative value of Block #2 is "45", and a representative value of Block #3 is "52". The size of a representative value of each of the blocks for storing representative values of the respective blocks is 6 bits, and thus, a total memory area of 18 bits is occupied. However, when a DPCM method is used in compression, increased and decreased values may be sequentially calculated based on each representative value. For example, "−5", which is the difference between the representative value of Block #2 and the representative value of the Block #1, and "7" which is the difference value between the representative value of Block #3 and the representative value of Block #2 may be stored. In this case, 6 bits may be required in order to store the representative value of the Block #1, 4 bits may be required in order to store "−5" which is the first difference value, and 3 bits may be required to store "7", which is the second difference value (S433-2).

The calculated values "50, "−5", and "7" may be compressed using an entropy coding method and may be stored in a memory area of a total of 13 bits (S434-2).

The values may also be compressed via the second compression method M2 using the representative value of each block. As shown in FIG. 8, the average data of 8 pixels of the first block are assumed to be 52, 58, 50, 60, 58, 62, 57, and 58. The size of each average data is 6 bits, and thus when the average data is stored without change, a memory area of a total of 48 bits may be required.

In the second compression method M2, "50", which is the smallest value of average data of 8 pixels may be set to a representative value. When the representative value is set, a difference value (residual) to be stored in each pixel may be calculated. That is, a difference value between the representative value and the average data of each pixel may be calculated. A minimum average data value is set to a representative value, and thus the difference value may not be represented with a negative (−) value unlike the case of the first compression method M1 (S433-1).

When the representative value and the difference value are compressed using a fixed-length coding, a representative value "50" may be stored with a size of 6 bits, and each difference value may be stored as the remaining stored value. The space for storing the difference value occupies 26 bits, and thus only a total memory area of 32 bits may be required (S434-1).

Figure 9:
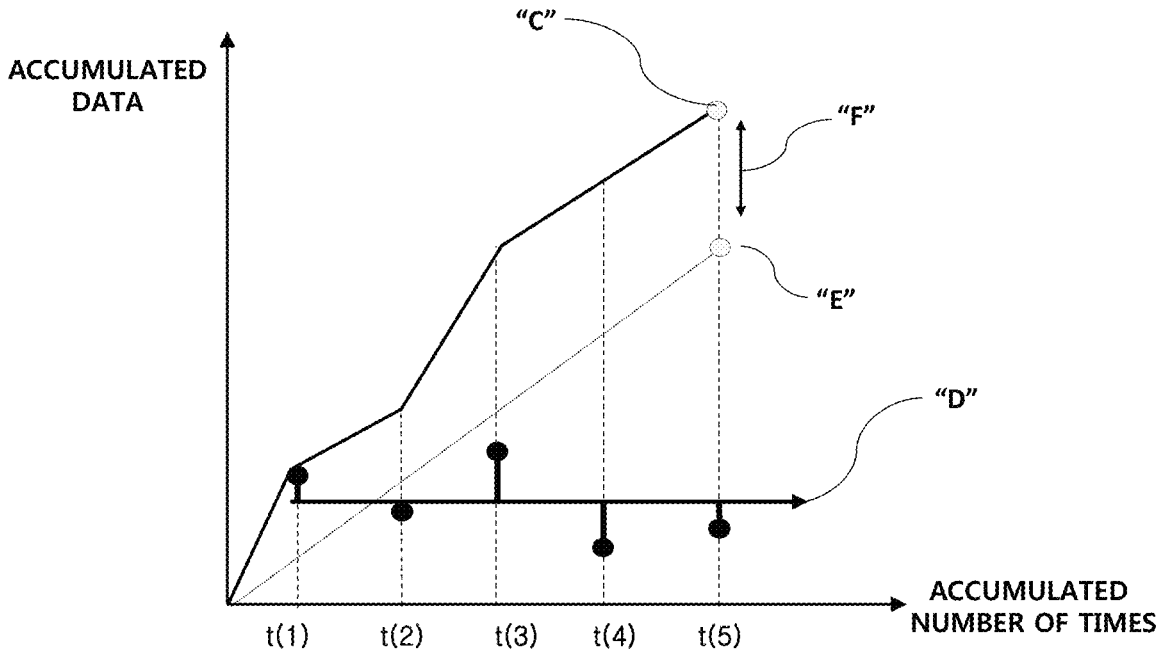
FIG. 9 is a diagram showing an example of accumulated data and average data with respect to an accumulated number of times in an irregular region.

FIG. 9 is a diagram showing an example of accumulated data and average data with respect to an accumulated number of times in an irregular region.

The accumulated stress data of input data in an irregular region may be non-linearly accumulated as shown in "C". For example, stress data of respective numbers of times have different values during five times (t(1),t(2), to t(5)) in an arbitrary pixel, and thus the accumulated stress data is non-linearly accumulated as shown in "C". In this case, the average data of five times is represented as "D". In this case, "E", which is a value obtained by multiplying "D" that is an average stress data value for each time, may be different from an actual accumulated stress data value "C" by a different value "F".

Figure 10:
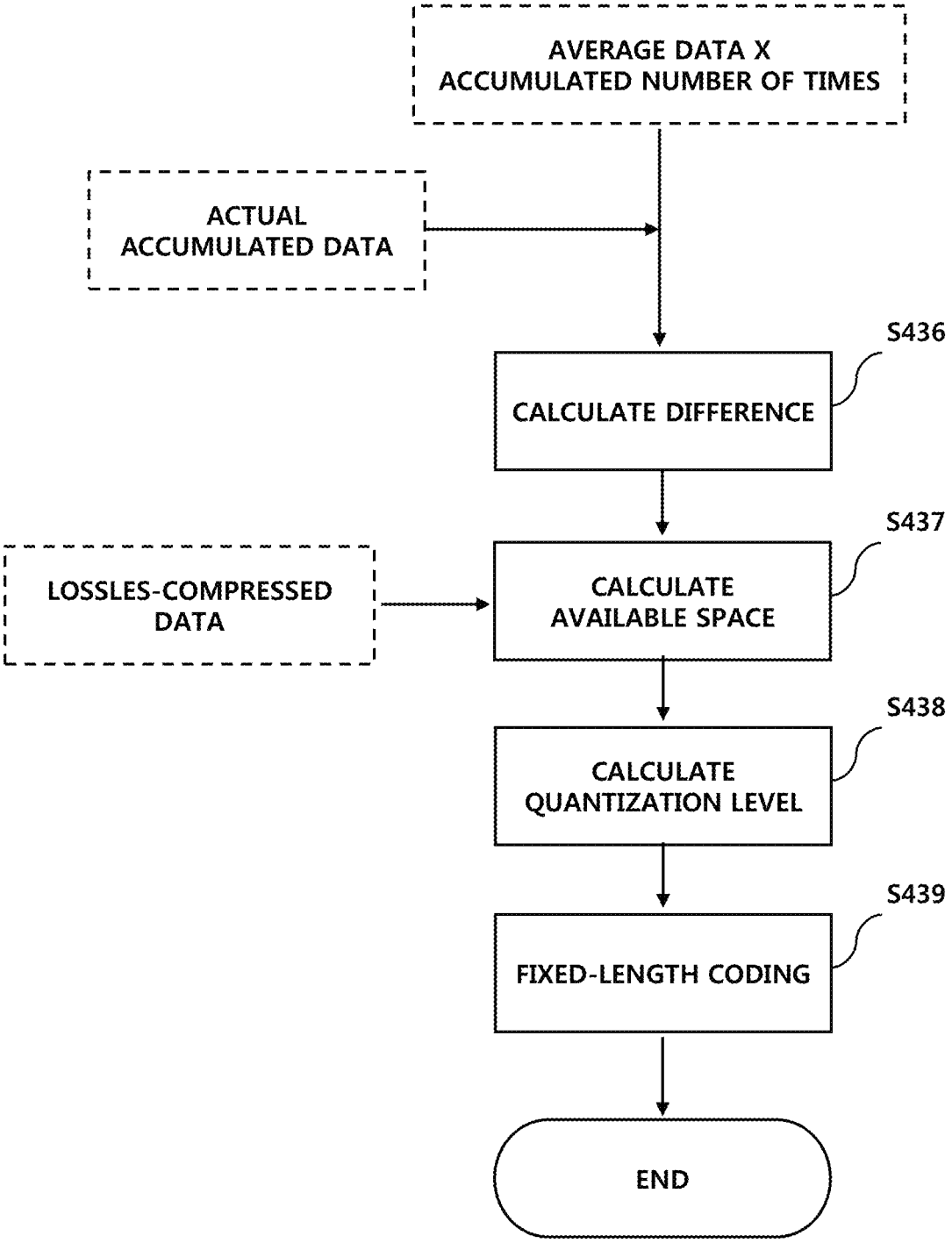
FIG. 10 is a flowchart showing lossy compression procedures in an irregular region of a compensation method of an organic light-emitting display device according to an embodiment of the present disclosure.

FIG. 10 is a flowchart showing lossy compression procedures in an irregular region of a compensation method of an organic light-emitting display device according to an embodiment of the present disclosure. In the irregular region, an image is changed, and thus an image sticking occurs less compared with a regular region in which an image is fixed. Thus, a lossy compression method is used in the irregular region. In this case, according to the present disclosure, an average data value may be used.

For lossy compression in the irregular region, the actual accumulated stress data value, the average stress data, and an accumulated number of times may be received and a difference value "F" may be calculated (S436).

Figure 11:
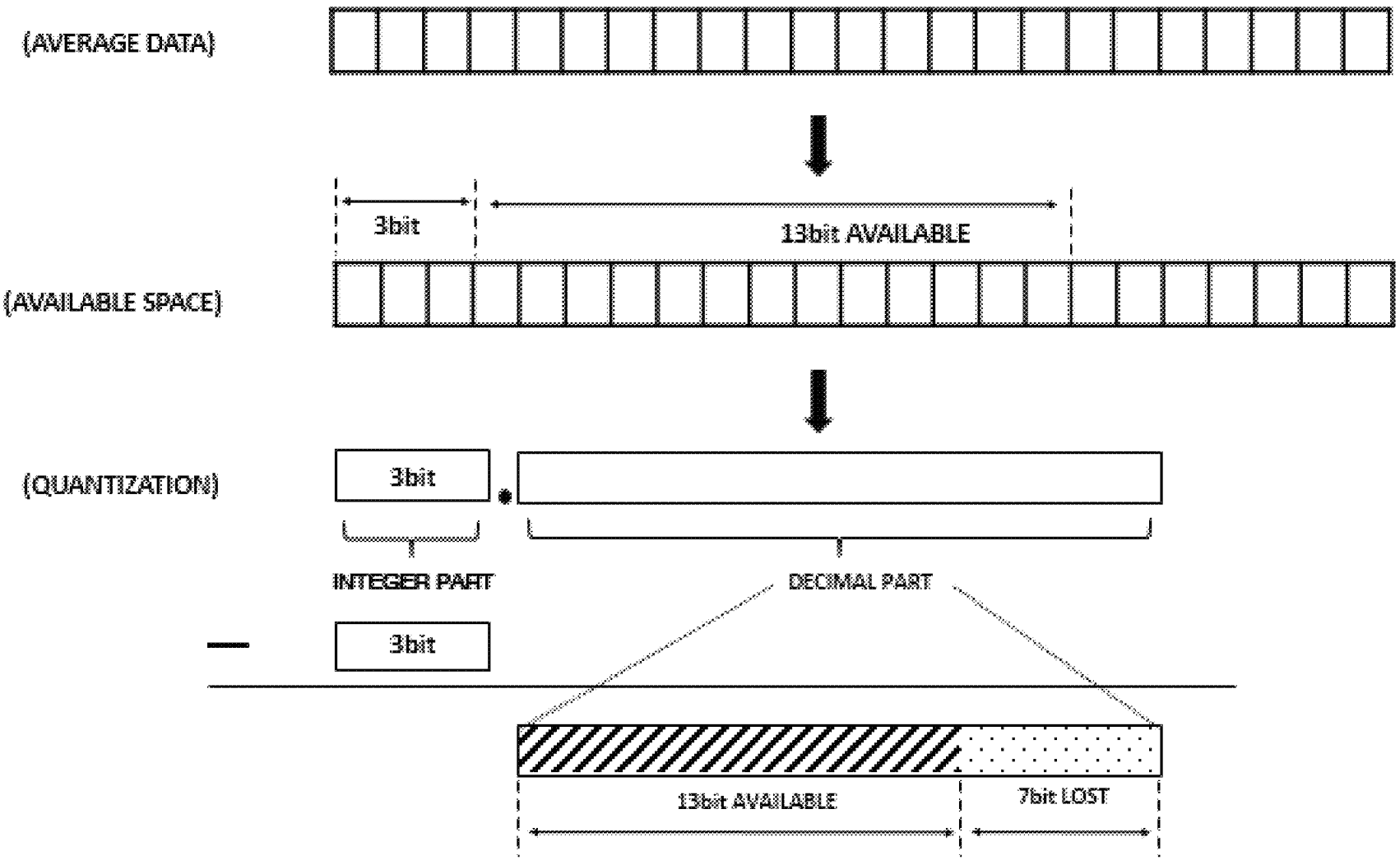
FIG. 11 is a diagram showing a memory processing procedure in a lossy compression method according to an embodiment of the present disclosure.

Information on lossless-compressed data in the regular region may be received and an available space may be calculated. For example, as shown in FIG. 11, an average stress data value may be obtained by dividing the actual accumulated stress data value by the accumulated number of times, and in this regard, the average stress data value is data for the irregular region, and thus may include an integer part and a decimal part. Assuming that data of 32 bits is compressed at a 2:1 ratio, the actual available memory size may be 16 bits. For example, when it is possible to compress the integer part to 3 bits, 13 bits of a storage space required after compression may be assigned to the decimal part (S437).

In order to store the difference value "F" corresponding to the available space, the difference value may be calculated at a quantization level (quantization) (S438).

When an actual decimal part has 20 bits, data may be compressed to an assignable size of 13 bits using a fixed-length coding method and may then be stored (S439).

As such, average data may be used, and thus the size of data to be compressed and restored at the time at which data is accumulated a predetermined number of times may be reduced, thereby improving compression efficiency.

As described above, a display device and a compensation method thereof according to the present disclosure may determine a compensation value using the average data of accumulated stress data, and thus compared with conventional compression technology, the lifetime of the display device may be improved because image sticking is compensated for, while a memory size may be reduced because compression technology is applied.

In the display device and the compensation method thereof, lossless compression may be performed in an important region using average data and lossy compression may be performed in a less important region, and thus deterioration of pixels may be compensated for by reducing loss in the regular region and improving ability to compensate for image sticking.

It will be apparent to those skilled in the art that various modifications and variations can be made in the present disclosure without departing from the spirit or scope of the inventions. Thus, it is intended that the present disclosure cover the modifications and variations of this invention provided they come within the scope of the appended claims and their equivalents.

What is claimed is:

1. A display device comprising:

a display panel comprising a plurality of pixels provided thereon and configured to display an image;

a display driver configured to output a driving signal for driving the display panel; and a timing controller configured to generate stress data by converting grayscale values included in image data into stress values, accumulate the stress data for each pixel, calculate average data for each pixel corresponding to an accumulated number of times, determine a compensation value by performing lossless compression and restoration on the average data in a regular region and lossy compression and restoration on the average data in an irregular region, respectively, and to provide the compensation value to the display driver.

2. The display device of claim 1, wherein the timing controller maps each of the grayscale values included in the image data to a predetermined mapping table and converts the mapped data into the stress data.

3. The display device of claim 2, wherein the timing controller comprises:

a data accumulator configured to accumulate the stress data and to extract accumulated stress data;

an average data processor configured to perform compression and restoration using the average data calculated by dividing the accumulated stress data accumulated by the data accumulator by an accumulated number of times;

a memory configured to store a compressed data provided from the average data processor; and a deterioration and compensation value determiner configured to predict deterioration by analyzing the accumulated stress data restored by the average data processor and to determine the compensation value for the deterioration.

4. The display device of claim 3, wherein the accumulated stress data has a size of 32 bits, and the average data has a size of 16 bits.

5. The display device of claim 3, wherein the data accumulator comprises:

a current usage calculator configured to calculate usage of a current pixel by analyzing current image data; and an accumulated usage calculator configured to calculate the accumulated stress data by accumulating the data calculated by the current usage calculator.

6. The display device of claim 5, wherein the average data processor comprises:

an average data compressor configured to extract a representative value of the average data for each pixel of each block by dividing each pixel line of the display panel into a plurality of blocks, determine a difference value between the average data for each pixel of each block and the representative value, compress the difference value to a size required to store the difference value, and to store the difference value in the memory; and an average data restorer configured to extract the representative value by reading the compressed data stored in the memory and to restore the accumulated data using the difference value.

7. The display device of claim 6, wherein the average data compressor uses a lossless compression method in a regular region in which an image is fixed and a lossy compression method in an irregular region in which an image is changed, using a DPCM method, entropy coding, and a fixed-length coding algorithm.

8. The display device of claim 7, wherein the average data compressor calculates an available space of compressed data from an amount of lossy-compressed data, performs quantization to compress the difference value from the accumulated data only by as much as the available space, and compresses the quantized difference value to a predetermined bit size.

9. The display device of claim 1, wherein the plurality of pixels comprises an organic light-emitting diode (OLED).

10. The display device of claim 9, wherein the compensation value is image-sticking compensation data for compensating for deterioration of the plurality of pixel units.

11. A compensation method of a display device, the method comprising:

generating stress data by converting grayscale values included in image data to be displayed on a display panel into stress values;

calculating average data of the stress data for each pixel;

compressing the average data;

storing the compressed average data in a memory;

reading the compressed average data stored in the memory and restoring accumulated stress data using the compressed average data;

predicting deterioration by analyzing the restored accumulated stress data and determining a compensation value for the deterioration; and driving the display panel using the compensation value, wherein the compressing the average data comprises performing a lossless compression method in a regular region in which an image is fixed and a lossy compression method in an irregular region in which an image is changed.

12. The method of claim 11, wherein the calculating the average data includes:

calculating usage of a current pixel by analyzing current image data;

calculating accumulated stress data by accumulating the usage of the current pixel; and calculating the average data by dividing the accumulated stress data by an accumulated number of times.

13. The method of claim 12, wherein the accumulated stress data has a size of 32 bits, and the average data has a size of 16 bits.

14. The method of claim 12, wherein the compressing the average data comprises:

extracting a representative value of average data for each pixel of each block by dividing each pixel line of the display panel into a plurality of blocks;

determining a difference value between the average data for each pixel of each block and the representative value; and compressing the difference value to a size required to store the difference value.

15. The method of claim 14, wherein the compressing the average data comprises:

performing a lossless compression using a DPCM method, entropy coding, and a fixed-length coding algorithm.

16. The method of claim 14, wherein the determining the compensation value comprises:

calculating a difference value from actual accumulated data by restoring accumulated data of lossless-compressed data;

calculating an available space of compressed data from an amount of lossy-compressed data;

performing quantization to compress the difference value from the actual accumulated data only by as much as the available space; and compressing the quantized difference value to a predetermined bit size.

17. The method of claim 11, wherein the compensation value is image-sticking compensation data for compensating for deterioration of a plurality of pixel units of the display panel.

* * * * *